US008359718B2

(12) United States Patent
Yeung

(10) Patent No.: US 8,359,718 B2
(45) **Date of Patent: *Jan. 29, 2013**

(54) ROUGHNESS INSULATED SHEATH COVERING

(75) Inventor: Kam Yuen Ricky Yeung, Hong Kong (CN)

(73) Assignee: Leadtheway Hook & Eye Tape Limited, Kwai Chung, N.T. Hong Kong (CN)

( * ) Notice: Subject to any disclaimer, the term of this patent is extended or adjusted under 35 U.S.C. 154(b) by 326 days.

This patent is subject to a terminal disclaimer.

(21) Appl. No.: 12/800,736

(22) Filed: May 21, 2010

(65) Prior Publication Data

US 2011/0283489 A1 Nov. 24, 2011

(51) Int. Cl.
*A44B 13/00* (2006.01)

(52) U.S. Cl. ..... 24/591.1; 24/697.1; 450/79

(58) Field of Classification Search ..... 24/591.1–596.1, 24/DIG. 43, 697.1, 697.2; 450/86, 58, 88, 450/63, 64, 71, 73, 79, 82
See application file for complete search history.

(56) References Cited

U.S. PATENT DOCUMENTS 2,802,215 A 8/1957 Alfandre
2,861,276 A 11/1958 Alfandre
6,309,489 B1 10/2001 Fildan et al.
6,520,832 B2 2/2003 Devita et al.
7,086,925 B2 8/2006 Kaye et al.
7,918,711 B2 * 4/2011 Yeung ..... 450/58
2008/0045122 A1 * 2/2008 Utaka ..... 450/25
2008/0295302 A1 12/2008 Senn

OTHER PUBLICATIONS

WO 01/914492 entitled Connector Element for End Sections of Pieces of Clothing to Be Connected.
WO 01/914492 entitled Connector Element for End Sections of Pieces of Clothing to Be Connected Dec. 6, 2001.

* cited by examiner

*Primary Examiner* — James Brittain
(74) *Attorney, Agent, or Firm* — Curtis L. Harrington; Harrington & Harrington

(57) ABSTRACT

An enveloping roughness insulative layer of material is provided which need have no connection to a connection member, such as a female eyelet support before the female eyelet support and enveloping roughness insulative layer of material is attached to the main garment structure. The enveloping roughness insulative layer of material can be formed while attached to a connection member or it can be formed independent of the connection member. The enveloping roughness insulative layer of material is preferably formed into an envelope shape and may be made from a planar layer of material or result in closure of an annular tubular expanse of material.

5 Claims, 3 Drawing Sheets

ROUGHNESS INSULATED SHEATH COVERING

BACKGROUND OF THE INVENTION

This invention relates to an improved method and technique for attachment of a roughness insulating sheath covering to enable roughness insulation of any of a variety of structures to which the sheath may be attached, with structural engagement through members extending through the sheath.

BACKGROUND OF THE INVENTION

A number of varieties of clothing have connector structures which must provide substantial holding ability. In general, where a fastener is used, the underlying structure is such that it must support a fastener and also the lateral forces necessary for clothing support. The support of the fastener is the more critical factor, with the attachment of the fastener to an underlying structure requiring a significant invasion of the underlying fastener, such as by stitching, forming a significant physical disruption to the underlying fastener. These lateral disruptions produce a "roughness" factor to the wearer, particularly where the structures have significant force bearing capability.

Invasions of steep stitching into material of sufficient thickness to accept the stitches forms something akin to a sand paper pad. The covering of both the material and stitches is required to effectively insulate the wearer from roughness. One method which has developed is the attachment to the material of a softer material which can be folded over the rough areas. The problems of this approach include the addition of the soft layer to an already thickened set of layers necessary to support the force of the connector and transmit it effectively to the underlying attachment material.

Where stitching of fabric is used to both hold the connector and to support a covering layer, a minimum thickness, and usually a bulky thickness is established. Bulkiness of the support material which supports the connectors or fasteners adds to the roughness by providing an expanded member which is naturally pressed even more tightly against to the body to thus cause even more unwanted abrasion.

In addition, most sewn flaps are subject to the same sewing rigors as the layers of material they are trying to protect. The sewn flap must have thread which is strong enough to pierce the soft layer and all of the strengthened layers beneath it. In short, the sewing of the softened flap onto a series of multiple layers may add as many roughness problems as it tries to help eliminate.

The standard use of a multi-layered support structure can require a significant amount of sewing, bolting, stapling and not including the portion of the structure which attaches to another structure. The ability to reduce the main attachable support structure while at the same time providing a soft insulative material has presented an insurmountable problem. Part of the obstacle in this problem is the cost of manufacture. The connecting portions of a garment are of higher cost than the main expanses of material, require more labor to construct, and are the focal point of quality control as a failure is more likely occur at an attachment point. The multiple labor steps and multiple structure steps add multiply the potential for quality failure.

One such connector and support structure is the bra main strap connector. The horizontally extending bra main strap connector typically bears the most continuous force in the bra assembly of straps. A male connector having a pair of spaced apart male hooks are directed toward the user's body and against a female connector. The female connector carries a plurality of corresponding eyelets to enable the hooks of the male connector to engage at differing positions along the length of the female connector.

The female connector thus has a plurality of eyelets, each of which has to be stabilized and oriented with respect to the female connector, and which also creates a dual plurality of invasive connection members as stitches to protrude out of the back side of the female connector and against the skin of the user. As before, a covering flap requires further stitching to connect such covering flap to the connector and may actually increase the roughness which is sought to be lessened. Thus, both a covering flap attached to the main support and the attachment of the eyelets to the main support can make the roughness problem worse.

Further, in the case where stitching is used as a general assembly and connection strategy, other connection strategies for the female support are sometimes precluded. In most cases, a softness layer may be precluded from attachment to a non-sewable eyelet support, either because the method of attachment of the softening layer creates a rougher projection (such as gluing or stapling), or where stitching might not be able to penetrate the main support.

The garment business is extremely competitive, and a savings of fractions of a penny can translate into either being competitive or non-competitive. Making the female connector softer usually involves added layers, attachment, labor, and the like. Where a manufacturer must justify each minute fractional addition to the garment, a decision may have to be made to use a connector which is not roughness insulated if its cost is too high, or even if it is not sufficiently competitively low.

As a result of all of the above factors, there exists no roughness mitigative assembly which can offer (1) a wider freedom of choice in support structure for the eyelets, (2) a minimization of risk of adding to the roughness if it is not installed properly, and (3) a greater freedom to control the cost of the female eyelet connector while providing elimination of roughness.

SUMMARY OF THE INVENTION

An enveloping roughness insulative layer of material is provided which need have no connection to the female eyelet support before the female eyelet support and enveloping roughness insulative layer of material is attached to the main garment structure. In the case of a bra, this main garment structure is the horizontal main bra strap member. Further, the enveloping roughness insulative layer of material has a number of features not previously seen in softness insulative strategies, especially in the case of bra female eyelet connectors.

First, an insulative sleeve has ultrasonically cut slits for admitting the attachment eyelets. This technique is to form slits in the enveloping roughness insulative layer of material which are sized to admit the "U" protrusions of the female eyelet members through each respective one of the ultrasonically cut slits using generated heat. The first advantage of using ultrasonically cut slits is that a close controlled tolerancing of the width of the ultrasonically cut slits with respect to the "U" protrusions of the female eyelet to insure that there is no significantly exposed slit that might catch on another structure. The second advantage is that the use of ultrasonics with ultrasonically generated heat forms a melt stabilization of the material to insure that no unraveling will take place. Third, the angle of cut can be adjusted to facilitate guiding of the "U" protrusions of the female eyelet through the formed slits. Fourthly, the slits can be formed into an enveloping roughness insulative layer of material independently and separately from steps involving formation of the underlying support, and attachment of the female eyelet onto the underlying support. Where the enveloping roughness insulative layer of material has portions of its area located "away" from the formed slits, it enables the precision of placement of the slits to be matched generally with the placement of the female eyelets. Put another way, the enveloping roughness insulative layer of material can have extra material, or even thicker material, to thus relax the overall tolerance with respect to the support layer.

Fifthly, the elimination of the need to be primarily concerned with how the enveloping roughness insulative layer of material attaches to the main support enables a relaxation of the constraints by which the remainder of the enveloping roughness insulative layer of material is either attached to the main support, attached to the main garment, or attached to itself in closure. In this manner, the enveloping roughness insulative layer of material can be controlled with respect to the main support by means other than direct attachment to it. The enveloping roughness insulative layer of material can be fitted to stretch against the end of the support not attached to the main garment material. The enveloping roughness insulative layer of material can be stretched against the slits which admit the "U" protrusions of the female eyelet through the formed slits. In another example, where the open end of the enveloping roughness insulative layer of material which would lie adjacent to the main clothing connector end to which the main support would attach, the enveloping roughness insulative layer of material may be left lightly attached. Such light attachment may be just enough to insure that the enveloping roughness insulative layer of material slits do not slip off the "U" protrusions of the female eyelet. Almost finally, where there are any seams necessary to complete the enveloping roughness insulative layer of material, those seems need not occur evenly at the planar edge of the support material. The enveloping roughness insulative layer of material can be formed with a pair of planar expanses which are uneven to cause the joining seams to lie on one side of the planar support, and away from the portion of the enveloping roughness insulative layer of material which comes into contact with the user's skin. And finally, the enveloping roughness insulative layer of material can be formed as a tube so that it has no upper and lower edge joinder, leaving only an end edge and a portion which is adjacent the point of attachment to the main expanse of material.

The use of an enveloping roughness insulative layer of material can have as many as two expanses of material joined on three sides to form a pocket with the edges of the open end of the pocket then either sewn onto the main garment, or partially attached, or allowed to remain free. By use of a folded material to eliminate a joined side, only two sides need to be attached to each other to form a three sided pocket. With an extruded annular length of cloth, only one sides needs to be joined to form a pocket. Thus, limited pocket forming translates into less thread for pocket forming. Moreover, since stitching used for the formation of the pocket shape need only join near the edges of the softness material and not through tough layers of any support for the female eyelets, the stitching thread can also be soft and not thick. The number of stitches and the type of thread will depend upon other characteristics required for the roughness insulated sheath covering, rather than the more stringent requirement of having to stitch through the support for the female eyelets.

Further, because the enveloping roughness insulative layer of material covers the eyelet side of the connector very closely toleranced to the area immediately adjacent the "U" protrusions of the female eyelet, the male hook members essentially have no obstructions on which to "falsely catch" when being engaged with the "U" protrusions of the female eyelet. This enables the male bearing clothing connector to slide until engaged by a female eyelet. This reduces time wasted in dealing with annoying false catches during the engagement and fastening process by the user.

The ability to use a roughness insulated sheath covering frees the designer to use a wider variety of materials for the support for the female eyelets. The female eyelets can be supported on a material which is stronger and needle resistant. The attachment of the female eyelets to the support material is similarly freed. Female eyelet attachment can be accomplished by forming the support around the female eyelets, by ultrasonic implacement into the female eyelet support material, or by folding of the support material and gluing or welding about the bases of the female eyelets.

Once the female eyelets are formed on the base with their "U" protrusions of the female eyelet properly oriented, it is an easy matter to cause them to pass through the slits formed in the enveloping roughness insulative layer of material. This can be accomplished by hand or by machine. As the support for the female eyelets are moved into the enveloping roughness insulative layer of material, downward pressure is applied at a point just before each of the female eyelets once the associated proper slit is in position before the female eyelet. Further movement of the eyelet support into the enveloping roughness insulative layer of material will cause each of the female eyelets to slide through the proper slit. In a machine setting, a form with the correct number of located protrusions could be caused to make the depressions at the correct moment of movement of the support into the roughness insulative layer of material.

Further, the combination of the eyelet support and roughness insulative layer of material can be formed as a turned out structure where it is desired to insert the "U" protrusions of the female eyelet members through each respective one of the ultrasonically cut slits before the roughness insulative layer of material is formed into an envelope. In this case the eyelet support can be turned inside out, along with the side of the roughness insulative layer of material stabilized. The eyelet support will ideally be stabilized adjacent the layer of the roughness insulative material having the cut slits so that the "U" protrusions of the female eyelet members extending through each respective one of the ultrasonically cut slits will not be pulled back through the slits. Stabilization can be accomplished by adjacent gluing, or by shaping the "U" protrusions of the female eyelet members to resist being pulled back through the slits either by frictional contact, or providing a "U" shaped protrusion of the female eyelet members to engage the slot frictionally or as a forcefully pulled through locking engagement.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figures 1, 2:
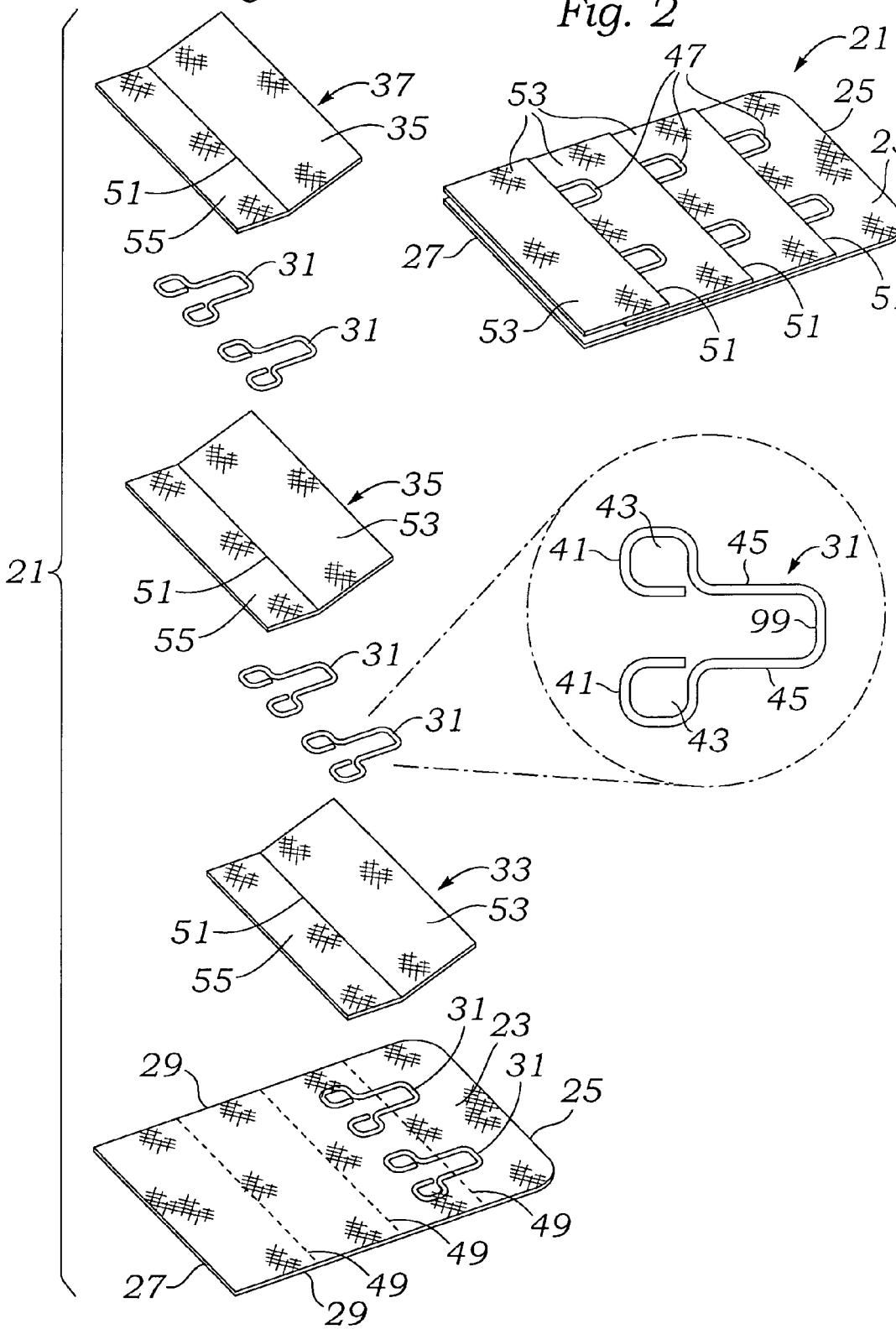
FIG. 1 is a schematic perspective view of one possible configuration of an eye loop support structure formed with a base layer onto which is located a series of folded and sewn layers.
FIG. 2 is a perspective view of the eye loop support layer seen in FIG. 1 in an assembled condition.

Referring to FIG. 1, an exploded perspective view of one possible configuration of an eye loop support structure 21 is shown as having a base layer 23 which can be made of any material depending upon the manner of attachment. Base layer 23 has a trailing end 25 and an attachment end 27, and a pair of side edges 29. The eye loop support structure 21 illustrated for example is formed with a base layer onto which is located a series of female eye loop connectors 31 and folded and sewn layers 33, 35, & 37 are attached.

An expanded view of one possible female eye loop connector 31 is seen to the right side of FIG. 1. The eye loop connector 31 is typically made from a small wire that has been cut and bent to a shape similar to that shown, or it could be any shape. Because the example shown is a sewn example, the shape of FIG. 1 works well with a sewn attachment. The eye loop connector 31 includes a pair of base eyelets 41 which may be formed with each having an opening 43 which may or may not be effectively closed depending upon the precision of the machine forming the eye loop connector 31. The use of the eyelets 41 are provided so that any sewing which ventures into those areas will hold the eye loop connector 31 securely. This type of arrangement works well with linear sewing across the rear portion of the eye loop connector 31 which is so small and smooth that it can easily deflect the sewing action of any needle directed toward the right hand base.

The eye loop connector 31 also has a pair of arms 45 which terminates at an end bar 47. The end bar 47 is typically compatible with any hook to be used with the eye loop connector 31. Where a hook (not shown) has a pair of evenly spaced members, the straight end bar 47 provides a balanced, stable connection. Further, the arms 47 enable the manufacturer to determine the extent to which the end bar 47 is to extend from the other portions of the eye loop connector 31.

A set of three stitching lines 49 are shown as extending across the base layer 23 to illustrate the locations at which the folded and sewn layers 33, 35, & 37 will be attached. Note that the stitching line which runs over the eye loop connectors 31 shown on the base layer 23 will secure both the eye loop connectors 31 and sewn layer 33 seen above.

Sewn layer 33 has a fold 51 which will be engaged by stitching of the stitching line 49 and which divides the sewn layer 33 into two halves, including a relatively wider half 53 and a relatively narrower half 55. The relatively wider half 53 will fold toward and cover the relatively narrower half 55 of the sewn layer 33 after sewn attachment along stitching line 49 is completed. The use of the folded sewn layer 33 accomplishes several objectives. First, it provides isolation of the base eyelets 41 and openings 43 of the female eye loop connectors 31. Second, the relatively wider half 53 will be captured under the next rightmost stitching line 49 so that the relatively narrower half 55 will be completely captured and held down. Third, it insures that the pair of arms 45 and end bar 47 will protrude forward of the stitching line 49 and will be presented for engagement.

Following to the right, the sewn layer 35 also has a fold 51 which will be engaged by stitching of the middle stitching line 49 and which divides the sewn layer 35 the relatively wider half 53 and the relatively narrower half 55. Again, the relatively wider half 53 will fold toward and cover the relatively narrower half 55 of the sewn layer 33 after sewn attachment along the middle stitching line 49 is completed.

Following to the rightmost stitching line, the sewn layer 37 also has a fold 51 which will be engaged by stitching of the rightmost stitching line 49 and which divides the sewn layer 37 the relatively wider half 53 and the relatively narrower half 55. Again, the relatively wider half 53 will fold toward and cover the relatively narrower half 55 of the sewn layer 33 after sewn attachment along the middle stitching line 49 is completed. However, the trailing edge of the relatively wider half 53 may be tacked down to the base layer 23 or it may be left to float free, especially since the protrusion of the pair of arms 45 and end bar 47 beyond the fold to the left, does not require much consideration so long as some provision is made to keep the relatively wider half 53 to a position out of the way of the arms 45 and end bar 47 so that a male engaging member (not shown) can come directly down toward the base layer 23 and through the arms 45 and hook around the end bar 47.

Referring to FIG. 2 is a perspective view of the eye loop support layer 31 is seen in an assembled condition. Note that the base layer 23 can be seen to the left of the leftmost fold 51, while the other exposed layers, as seen from above, are the relatively wider halves 53 of the folded and sewn layers 33, 35, & 37. Although the pair of arms 45 of each female eye loop connectors 31 are not required in the fullness of their length to engage a male hook member (not shown), the use of the folded and sewn layers 33, 35, & 37 helps to maximally expose each of the pair of arms 45 and its end bar 47 so that it will correspondingly fit through slits of a roughness insulated sheath covering (to be shown). The eye loop support structure 21 seen in FIG. 2 is in a condition that it could be used to be attached to a portion of a garment, such as the main horizontal strap in a bra, and function to hold the garment in a fastened condition for wearing. But without a roughness insulated sheath covering (to be shown), any of the stitching which extends below the base layer 23 would have a high likelihood of irritatably contacting the skin of the user.

The eye loop support structure 21 seen in FIG. 2 can be formed by other methods than the sewn method illustrated. a thin base layer 23 can be molded and formed around female eye loop connectors 31 in a single step molding operation. In the alternative a non-woven layer could be formed at the attachment end 27. Further, a molded article could be made to be thin near one end (the attachment end 27) to facilitate sewing as a method of fixation to another clothing structure or other method of attachment.

Figure 3:
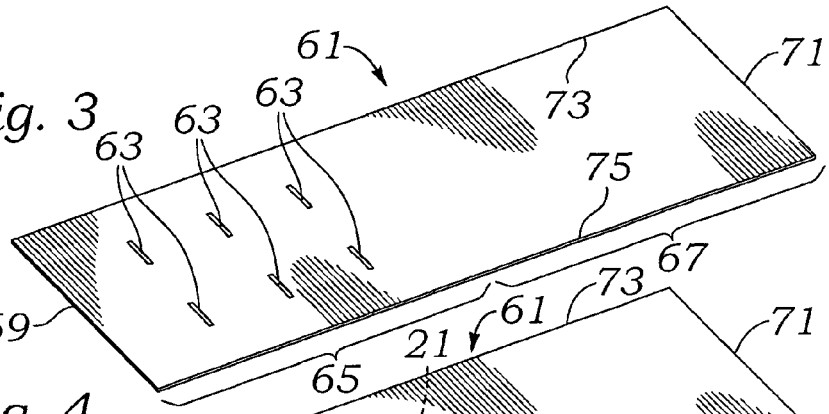
FIG. 3 illustrates an expanse of roughness insulative layer of material seen as a flattened rectangle before folding and illustrating a series of slits which are arranged to correspond to the location of the eye loops seen in the assembled eye loop support assembly seen in FIG. 2.

Referring to FIG. 3, an illustration of an expanse of roughness insulative layer of material 61 is seen as a flattened rectangular before folding and illustrating a series of slits 63 which are arranged to correspond to the location of the female eye loop connectors 31 of the assembled eye loop support structure 21 seen in FIG. 2. Slits 65 are preferably ultrasonically cut slits 63 or heat sealed slits 63 for admitting the attachment eyelets. The use of ultrasonic or heat cutting accomplishes two important objectives for the invention. First, the use of ultrasonics or direct heat, causes the material from which the an expanse of roughness insulative layer of material 61 is made, to avoid an unraveling at the sides or ends of the slits 63. Secondly, it enables much better control of the effective perimeter of the opening. It enables the use of friction between the slits 63 and the arms 45 of the female eye loop connectors 31 so that the mechanical action of either fitting the expanse of roughness insulative layer of material 61 over the eye loop support structure 21 or movement of the eye loop support structure 21 to push the pair of arms 45 and end bar 47 through the slits 63, can form a stabilizing connection. Thirdly, the formed width and length of the slits 63 can be controlled to further control the amount volume and vertical height of melted material and thus the ability to pre-specify a formed "slit material perimeter" depending upon a need based upon the type of fabric used. The remainder of the example of FIGS. 4-8 illustrate a series folding, sewing and turning inside-out steps. Although no clear delineation can be seen, expanse of roughness insulative layer of material 61, for the purposes of the folding example, has a slit bearing area 65 and a non-slit area 67. The expanse of roughness insulative layer of material 61 also has a pair of end edges 69 and 71, as well as side edges 73 and 75.

Figure 4:
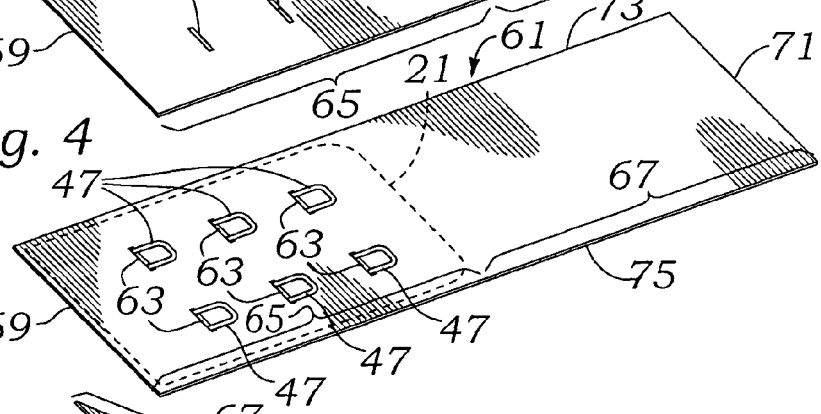
FIG. 4 illustrates the expanse of roughness insulative layer of material seen as a flattened rectangle as was seen in FIG. 3, but where the assembled eye loop support is positioned behind the not yet folded expanse of roughness insulative layer of material and with the plurality of eye loop "U" shaped protrusions of the female eyelet members protruding through the slits formed in the expanse of roughness insulative layer of material.

Referring to FIG. 4, the expanse of roughness insulative layer of material 61 seen as a flattened rectangle as was seen in FIG. 3, but where the eye loop support structure 21 is positioned behind the not yet folded expanse of roughness insulative layer of material 61 and with the plurality of eye loop "U" shaped protrusions of the female eye loop connectors 31, namely the pair of arms 45 and end bar 47 protruding through the slits 63 formed in the expanse of roughness insulative layer of material 61. In forming this combination it may be desirable to cause some manner of attachment between the slit bearing area 65 of the expanse of roughness insulative layer of material 61 and the surface of the eye loop support structure 21 as seen in FIG. 2. Any adhesive or fixturing attachment may preferably be between the exposed area of base layer 23 adjacent the trailing end 25, or possibly the main exposed areas of the relatively wider halves 53 of the folded and sewn layers 33, 35, & 37. Keeping in mind that the area of expanse of roughness insulative layer of material 61 which underlies the pair of arms 45 and end bar 47 will ultimately face away from the user and that the main limitation on the fixation of the opposing materials for fixation is that no obstruction or interference with the approach of the male hooking members (not shown) which will engage the end bar 47 should be introduced. a partial outline of eye loop support structure 21 is seen to show the position of the eye loop support structure 21 behind the expanse of roughness insulative layer of material 61.

Figure 5:
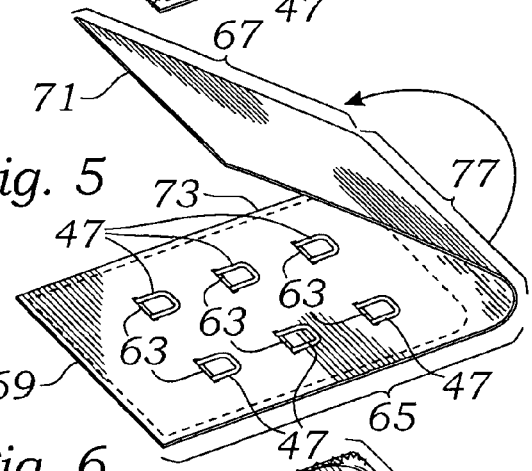
FIG. 5 illustrates the beginning of a folding action of the portion of the expanse of roughness insulative layer of material not containing the slits being folded over onto and in opposition to the expanse of roughness insulative layer of material containing the slits and covering the plurality of eye loop "U" shaped protrusions of the female eyelet members which extend through those slits.

Referring to FIG. 5, the folding action of the portion of the expanse of roughness insulative layer of material not containing the slits 67 being folded over onto and in opposition to the expanse of roughness insulative layer of material containing the slits 63 and covering the plurality of eye loop "U" shaped protrusions namely the pair of arms 45 and end bar 47 protruding through the slits 63 formed in the expanse of roughness insulative layer of material 61. Also seen is a fold formed edge 77 which will form one side of a pocket shape to be discussed with respect to FIG. 7.

Figure 6:
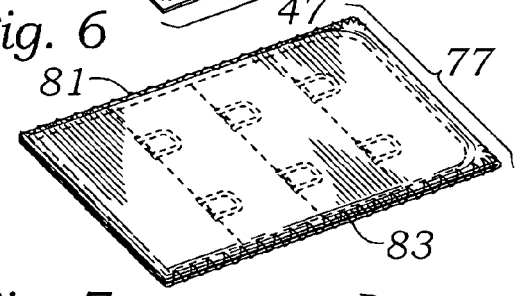
FIG. 6 illustrates, after the folding action of FIG. 5 is complete, the sewing of a pair of oppositely located edges of the portion of the expanse of roughness insulative layer of material not containing the slits onto the expanse of roughness insulative layer of material containing the slits, which, with the fold, forms a three sided pocket ready to be turned inside-out.

Referring to FIG. 6, an illustration of the resulting structure after the folding action of FIG. 5 is complete is shown. After folding, a first side stitch 81 joins the areas immediately adjacent side edge 73. The first side stitch 81 may extend partially into the fold formed edge 77. Similarly, a second side stitch 83 joins the areas immediately adjacent side edge 75, and the second side stitch 83 may also extend partially into the fold formed edge 77. The combination of the first and second side stitches 71 and 83 with the fold formed edge 77 forms a pocket structure which can be turned inside-out.

Note that the first and second side stitches 81 and 83, for maximum edge softness, may preferably not engage or secure to any part of the eye loop support structure 21 where it is important to make the stitching narrow and soft. Penetration of the eye loop support structure 21 might require a more stiff thread, and would occupy more space adjacent the eye loop support structure 21 and within the connector pocket assembly 85.

The inside of the formed pocket include the relatively wider halves 53 of the folded and sewn layers 33, 35, & 37, and the pairs of arms 45 and end bars 47 of the female eye loop connectors 31 on one side of the pocket opening and the non-slit area 67 of the expanse of roughness insulative layer of material 61 on the other side of the formed pocket. If the aforementioned formed pocket is turned inside out, the structure of FIG. 7 results.

Figure 7:
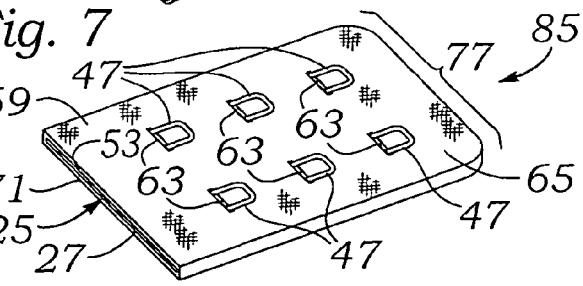
FIG. 7 is a view of the formed sleeve as seen in FIG. 6 after it has been turned inside out to form a combination female eyelet support carried within a roughness insulated sheath covering which is then ready for attachment to another garment either with or without attachment of the roughness insulated sheath covering attached to the other garment structure.

Referring to FIG. 7 a view of a post unfolded combination eye loop support structure within a pocket expanse of roughness insulative layer of material 85. Strictly, speaking, the structure seen in FIG. 6 is a pre-unfolded combination eye loop support structure within a pocket expanse of roughness insulative layer of material 85, but the structure of FIG. 6 is not ready for attachment to another portion of clothing, such as a horizontal bra strap (not shown).

Also, the outermost extents of the side edges 73 and 75 have been turned inside and the surfaces of the slit bearing area 65 and the non-slit area 67 transition into each other across turned in areas where only the crossing extent of the areas adjacent the first and second side stitches 81 and 83 may possibly be seen. At the left side of the post unfolded combination eye loop support structure within a pocket expanse of roughness insulative layer of material 85, hereinafter connector pocket assembly 85, the pair of end edges 69 and 71 are seen standing free. Depending upon the length of the eye loop support structure 21 chosen with respect to the overall length of the expanse of roughness insulative layer of material 61, the attachment end 25 of the base layer 23 may lie between and just within the edges pair of end edges 69 and 71 as is shown by the arrow at FIG. 7. Where the enveloping pocket shaped expanse of roughness insulative layer of material 61 is shorter, the trailing end 25 of the base layer 23 may protrude from between the edges pair of end edges 69 and 71.

Unless there is some fixation of the slit bearing area 65 of the expanse of roughness insulative layer of material 61 and the surface of the eye loop support structure 21, the eye loop support structure 21 could be manually withdrawn from the pocket shaped expanse of roughness insulative layer of material 61. Material handling concerns and machine loading of the connector pocket assembly 85, as well as the method and requirements of connection to the main garment may affect the decision on any pre-main garment attachment connection of the expanse of roughness insulative layer of material 61 and the surface of the eye loop support structure 21.

In the state in which it is seen in FIG. 7, the connector pocket assembly 85 can be attached to another expanse of material in any number of ways. The end edge 69 of the pocket shaped expanse of roughness insulative layer of material 61 plus the base layer 23 adjacent the attachment end 27 could be joined and attached to another expanse of material (not shown) while the end edge 71 of the pocket shaped expanse of roughness insulative layer of material 61 could be left free.

In another configuration, the of the pocket shaped expanse of roughness insulative layer of material 61 may have a weak connection to the eye loop support structure 21, and it may be that the pair of end edges 69 and 71 may both be left free, or in the alternative all three could be joined in the attachment operation. The configuration of the other attachment structure may dictate that the other attachment member may have two layers one or both which may fit between the end edge 69 and the eye loop support structure 21, and the other or both may fit between the end edge 71 and the eye loop support structure 21.

As further alternatives, the slit bearing area 65 and the non-slit area 67 of the expanse of roughness insulative layer of material 61 could be formed of separate and different materials. The main reason for folding when making the pocket shaped expanse of roughness insulative layer of material 61 is to substitute a fold formed edge 77 for a sewn edge which may be needed to form closure adjacent the trailing edge 25 of the base layer 23.

Using the main explanation of an inside-out folded model of FIGS. 3-7 as a starting point, certain other variations will be illustrated. It is clear that the pocket shaped expanse of roughness insulative layer of material 61 can be made separately without a co-folding operation with the eye loop support structure 21. In such a case, the eye loop support structure 21, regardless of how it was made, could be inserted into the open end of the pocket shaped expanse of roughness insulative layer of material 61. Tools and grasping instruments can be fashioned to accomplish this, depending upon the structure of the eye loop support structure 21 and other considerations.

Figure 8:
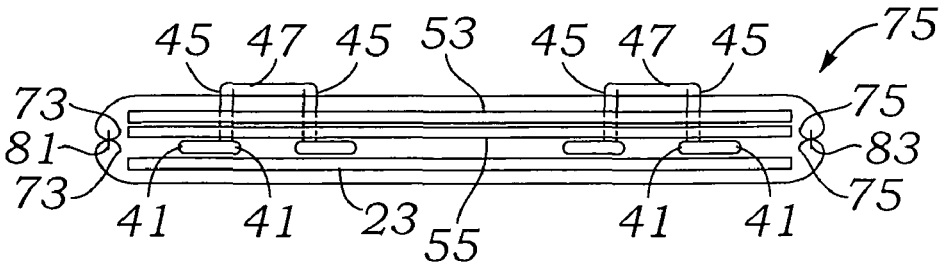
FIG. 8 illustrates an end sectional view looking into the open end of the formed pocket to reveal additional details.

Given that the pocket shaped expanse of roughness insulative layer of material 61 can be made separately, variations concerning the final location and nature of the first and second side stitches 81 and 83 and the shape and joinder of the areas of roughness insulative layer of material 61 can be varied. Referring to FIG. 8, an end sectional view looking into the open end of the formed pocket reveals a few details not specifically heretofore treated and will facilitate a discussion of the variations to be discussed. Strictly speaking the female eye loop connectors 31 may be flat, but in this case, the finished connector pocket assembly 85 will cause them to tilt slightly upward, and this is reflected in the view of FIG. 8.

Beginning at the bottom of FIG. 8, and looking into the open end of the formed pocket, the non-slit area 67 of the expanse of roughness insulative layer of material 61 is seen as joined to the slit bearing area 65 of the expanse of roughness insulative layer of material 61 at the right side of FIG. 8 by the second side stitch 83, and at the left side of FIG. 8 by the first side stitch 81. The first side stitch 81 can be seen as joining the expanse of roughness insulative layer of material 61 adjacent side edges 73, while the second side stitch 83 can be seen as joining the expanse of roughness insulative layer of material 61 adjacent side edges 75.

The layers within the pocket shaped expanse of roughness insulative layer of material 61, from the bottom, include base layer 23, and then the base eyelets 41 of the female eye loop connectors 31. The next layer is the relatively narrower half 55 of the folded and sewn layer 37, and then the relatively wider half 53 of the folded and sewn layer 37. Above the slit bearing area 65 of the expanse of roughness insulative layer of material 61, the pair of arms 45 and end bar 47 of the female eye loop connectors 31 are seen.

Figure 9:
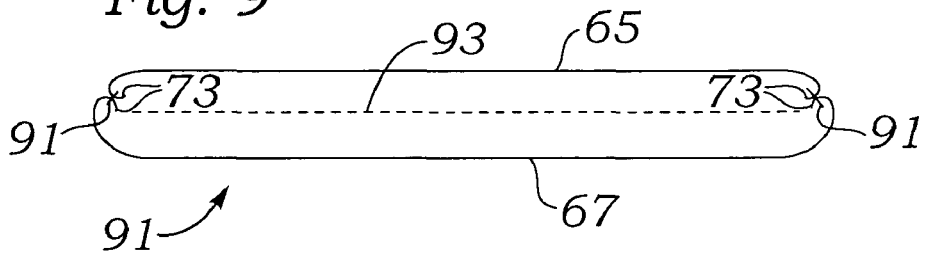
FIG. 9 illustrates an expanse of roughness insulative layer of material formed such that its non-slit area has an expanded width, while its slit bearing area has a narrowed width.

The view of FIG. 8 makes it clear that the space containing the side edges 73 and 75 is the only real potential left to be even further mitigated regarding the affect on the wearer whose body will oppose non-slit area 67 of the expanse of roughness insulative layer of material 61. This is in addition to the stitching which penetrates the base layer 23. FIG. 6 illustrates that the first and second side stitches 81 and 83 occur very close to the side edges 73 and 75 to minimize the occupancy of side edges 73 and 75 within the finished connector pocket assembly 85.

Where the side edges 73 and 75 must exist, and where it is possible to form the the expanse of roughness insulative layer of material 61 independently and before introduction of the eye loop support structure 21, the side edges 73 and 75 can be adjusted away from the non-slit area 67 of the expanse of roughness insulative layer of material 61. Referring to FIG. 9, a expanse of roughness insulative layer of material 91 is formed such that its non-slit area 67 has an expanded width, while its slit bearing area 65 has a narrowed width. The result of this structure is that the lateral joining seem, even if turned inside, can be shifted predominantly to the slid bearing area 67 side.

The formation of the expanse of roughness insulative layer of material 91 can be accomplished by folding, sewing the first and second side stitches 81 and 83 and then folding inside-out to form the pocket shape seen in FIG. 9. Sewing the first and second side stitches 81 and 83 can be accomplished by causing the side edges 73 and 75 to be even by stretching the slit bearing area 65 before sewing. In the alternative, the first and second side stitches 81 and 83 can be sewn separately by first evening and sewing one of the side edges 73 and 75, and then evening and sewing the other one.

Where two separate pieces of material are used for the slit bearing area 65 and non-slit area 67, an additional stitched side will be needed to close the end where the fold formed edge 77 would have otherwise been located. This is partially shown by the numeral 93. Further, the expanse of roughness insulative layer of material 61 used for the non-slit area 67 can be thicker and softer than that used for the slit bearing area 65.

Figure 10:
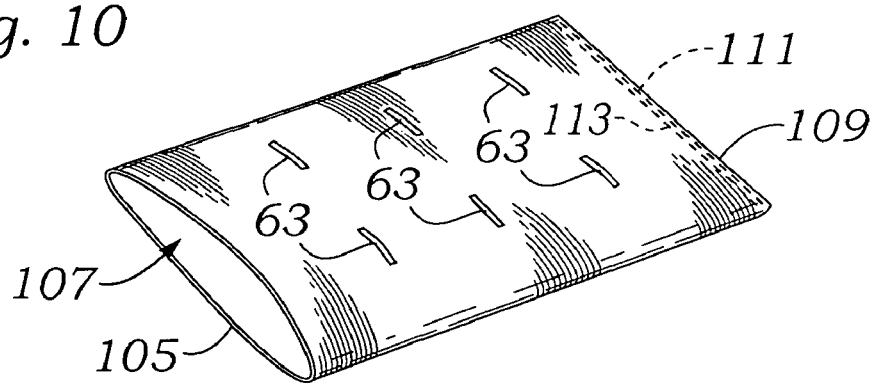
FIG. 10 illustrates a further embodiment of a roughness insulation layer which can formed as an annular extrusion with the necessity to close only one end, and whether or not inverted to place edges and stitching inside.

Referring to FIG. 10, it is known that both woven and non woven materials can be formed as an annular extrusion, like women's hosiery, stockings and the like. An annular shaped roughness insulative layer of material 101 is preferably originally formed as a tube having two open ends. Closure of only one of the ends is necessary to form a pocket shape. The annular shaped roughness insulative layer of material 101 has an open end 105 which is shown somewhat open. a second or closed end 109 is closed with a stitch 111 just inside a second end edge 113 where it is desired to keep the edges of the closed end edge 113 within the expanse of roughness insulative layer of material 91. Once the second end 109 is closed with stitch 111, the annular shaped roughness insulative layer of material 101 may be turned inside out. This is what is shown in FIG. 10, and thus it is shown as having a stitch 111 and second end edge 113 internal and thus shown in dashed line format. Also seen are the preferably ultrasonically cut slits 63 or heat sealed slits 63.

The advantages of the annular shaped roughness insulative layer of material 101 are several. First, another edge of stitching is eliminated. The fold formed edge 77 of the expanse of roughness insulative layer of material 61 eliminated one edge of stitching. The annular shaped roughness insulative layer of material 101 eliminates a second edge of stitching necessary to form a pocket shape. Secondly, the internal stitch 111 and its space occupying second end edge 113 is moved away from the upper and lower user-worn edges (actually side edges 73 and 75) of the connector pocket assembly 85, and into a position adjacent the location of the trailing end 25 of the eye loop support structure 21 upon insertion of the structure 21 into the pocket opening 107. Thus one of the few remaining factors which could cause discomfort to a wearer might be the only row of stitching 111 left. However, where this stitching and excess portions of the end edge 113 adjacent the stitching 111 only occupy a position at the trailing end 25 of the eye loop support structure 21, namely the portion of the connector pocket assembly 85 which will certainly not be pressed against the body of the user, and any roughness effects from this stitching is essentially eliminated.

Third, the use of annular shaped roughness insulative layer of material 101 invites the use of a softer and more stretchable material. a mechanical device which helps load the eye loop support structure 21 into the annular shaped roughness insulative layer of material 101 can stretch the material both in width and height to facilitate the loading in of the eye loop support structure 21. Release of the annular shaped roughness insulative layer of material 101 can be used to "hug" the eye loop support structure 21 and thus provide some stability for the resulting connector pocket assembly 85.

As before, the movement of the end bar 47 and pair of arms 45 into and through the slits 63 can be done in a number of ways. a form with selective depression projections can engage the surface of the annular shaped roughness insulative layer of material 101 just on the side of each of the slits 63 closest to the second or closed end 109 to cause the slits 63 to open slightly so that further movement of the eye loop support structure 21 to cause the end bar 47 and pair of arms 45 to be automatically guided through the slits 63.

Figure 11:
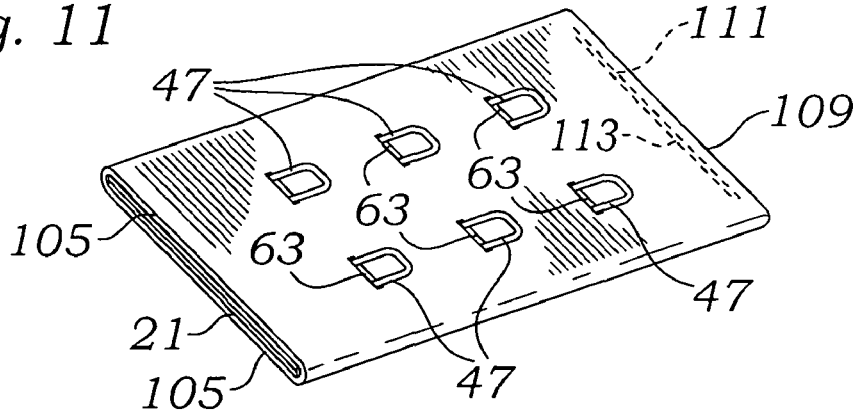
FIG. 11 illustrates the annular shaped roughness insulative layer of material of FIG. 10 when loaded with an eye loop support structure seen in FIG. 2 to forms a resulting combination eye loop support structure within an annular shaped roughness insulative layer of material.

Referring to FIG. 11, the annular shaped roughness insulative layer of material 101 when loaded with an eye loop support structure 21 forms a resulting combination eye loop support structure within an annular shaped roughness insulative layer of material 115, hereinafter connector pocket assembly 115. Again, another expanse of material may be attached in between the eye loop support structure 21 and an expanse of annular shaped roughness insulative layer of material 101 lying to either side of the eye loop support structure 21, or to the outside of the annular shaped roughness insulative layer of material 101.

While the present invention has been described in terms of a soft clothing connector which includes a separable pocket shaped roughness insulative layer of material and an eye loop support structure within the pocket formed roughness insulative layer of material, to minimize stitching and to help isolate any roughness that might otherwise make unwanted contact with the consumer's body will be softened, one skilled in the art will realize that the structure and techniques of the present invention can be applied to many clothing appliances and especially appliances which utilize the embodiments of the invention or any process which utilizes the steps of the invention.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. a clothing attachment connector with softening layer comprising:

a connection member having a first side having connection structures and a second side, and having at least a pair of oppositely disposed edges and a first and a second end edge;

a soft roughness insulating covering layer having a slit bearing area including a plurality of slits through which said connection structures extend, and a non-slit area, the soft roughness insulating covering layer having a pair of oppositely disposed edges joined together to form a pocket having an end edge between said pair of oppositely disposed edges, and enveloping said connection member to pocketingly surround said connection member while enabling said connection structures of said connection member to protrude through said plurality of slits of said soft roughness insulating covering layer.

2. The clothing attachment connector with softening layer as recited in claim 1 wherein the connection structures include eye loop members.

3. The clothing attachment connector with reversible softening layer as recited in claim 1 wherein said connection member has a pair of adjacent layers at said end edge to accept a connection to another clothing structure.

4. The clothing attachment connector with softening layer as recited in claim 1 wherein the slit bearing area of the soft roughness insulating covering layer is attached to said first side of said connection member.

5. a clothing attachment connector with softening layer comprising:

a connection member having a first side having connection structures and a second side, and having at least a pair of oppositely disposed edges and a first and a second end edge;

an annular shaped soft roughness insulating covering layer having a first open end and a second closed end and having a slit bearing side including a plurality of slits through which said connection structures extend, and a non-slit side, the second closed end of said annular shaped roughness insulating covering layer to form a pocket shape and enveloping said connection member to pocketingly surround said connection member while enabling said connection structures of said connection member to protrude through said plurality of slits of said annular shaped soft roughness insulating covering layer.

* * * * *